US005632117A

United States Patent [19]

Prete et al.

[11] Patent Number: 5,632,117

[45] Date of Patent: May 27, 1997

[54] SASH BALANCE BRAKE ASSEMBLY

[76] Inventors: James G. Prete, 925 Allmen, Hinsdale, Ill. 60521; Steven E. Schultz, 545 Begonia SE., Unit A, Demontte, Ind. 46310; Allen D. Polowinczak, 2716 Frank Turk Dr., Plainfield, Ill. 60544

[21] Appl. No.: 372,563

[22] Filed: Jan. 13, 1995

[51] Int. Cl.[6] ..... E05D 15/22

[52] U.S. Cl. ..... 49/181

[58] Field of Search ..... 49/181, 453, 446

[56] References Cited

U.S. PATENT DOCUMENTS

| | | | |
|---|---|---|---|
| 3,055,063 | 9/1962 | Peters . | |
| 3,482,354 | 12/1969 | Trout | 49/181 |
| 3,844,066 | 10/1974 | Nobes | 49/182 |
| 3,959,926 | 6/1976 | Noecker et al. | 49/181 |
| 4,068,406 | 1/1978 | Wood | 49/181 |
| 4,227,345 | 10/1980 | Durham, Jr. | 49/181 |
| 4,363,190 | 12/1982 | Anderson | 49/181 |
| 4,452,012 | 6/1984 | Deal . | |
| 4,581,850 | 4/1986 | Simpson | 49/181 |
| 4,590,708 | 5/1986 | Campodonico | 49/181 |
| 4,610,108 | 9/1986 | Marshik | 49/181 |
| 4,683,676 | 8/1987 | Sterner, Jr. | 49/181 |
| 4,718,194 | 1/1988 | FitzGibbon et al. | 49/181 |
| 4,854,077 | 8/1989 | Rogers et al. | 49/181 X |
| 4,914,861 | 4/1990 | May | 49/181 |
| 4,958,462 | 9/1990 | Cross | 49/181 |
| 5,127,192 | 7/1992 | Cross | 49/181 |
| 5,243,783 | 9/1993 | Schmidt et al. | 49/181 |
| 5,377,384 | 1/1995 | Riegelman | 49/181 X |

*Primary Examiner*—Philip C. Kannan
*Attorney, Agent, or Firm*—Wallenstein & Wagner, Ltd.

[57] ABSTRACT

A sash balance brake assembly for a sash window system is disclosed. The sash window system includes a window frame having a pair of generally parallel tracks. Each of the tracks has an outer wall, front and back intermediate walls and front and back inner walls collectively defining a channel. A sash window is transversely disposed between the tracks and is adapted for slidable movement along the tracks. A pair of sash balance assemblies provide a generally upward bias on transverse sides of the sash window. The sash balance brake assembly comprises a rotor rotatable about a rotor axis, a bolt having a generally planar engaging surface, a slider body for placement in a respective one of the channels and for coupling to a respective one of the sash balance assemblies. The slider body includes an aperture for rotatably supporting the rotor adjacent the bolt. The rotor and the bolt include cooperative camming surfaces for converting rotary motion of the rotor into movement of the bolt along the rotor axis, such that the bolt engaging surface selectively engages and disengages the track outer wall.

22 Claims, 3 Drawing Sheets

SASH BALANCE BRAKE ASSEMBLY

DESCRIPTION

1. Technical Field

The present invention relates to sash balance brake assemblies for pivotable sash windows.

2. Background Prior Art

Pivotable sash balance window systems wherein a sash window is permitted to pivot, such as for cleaning, are well known. Typically such window systems include a pair of pivot pins which extend from opposite sides of the sash window, and which engage a respective pair of sash balance brake assemblies. See, for example, U.S. Pat. No. 5,371,971, the specification of which is expressly incorporated by reference.

Such window systems typically include a pair of tracks within a window frame. The tracks each have an outer wall, front and back intermediate walls and front and back inner walls collectively defining a channel. Each of the sash balance brake assemblies are disposed in a respective one of the channels, and the brake assemblies lock the window vertically in place when the window is pivoted.

One style of sash balance brake assemblies utilizes an eccentric rotor disposed in an expandable housing. As the window is tilted, the eccentric rotor rotates, causing the housing to expand against the front and back intermediate wall of its respective track. Such style has worked satisfactorily; however as the expansion force of the housing is applied against the intermediate front and back walls, which are a generally weaker portion of the track, the braking effectiveness is limited.

Another style is disclosed in Cross, U.S. Pat. No. 5,127,192. According to Cross, an eccentric rotor expands the housing, similar to the previously discussed style. In addition, the rotor has a camming surface which engages the housing, causing the rotor to move outwardly relative to the housing and to engage the outer wall. Because the rotor simultaneously expands the housing as well as engages the outer wall, it can be difficult to control the amount of force respectively applied.

According to still another style, a metallic bracket is pivotally connected to the housing on the side of the housing facing the outer wall. A rotor is provided having a camming surface engaging the bracket. As the rotor is rotated, the bracket pivots outwardly to engage the outer wall of the track. Because the bracket engages the outer wall at an angle, it can be difficult to release the bracket from the outer wall.

The present invention is provided to solve these and other problems.

SUMMARY OF THE INVENTION

It is an object of the invention to provide an improved sash balance brake assembly for a sash window system.

The sash window system includes a window frame having a pair of generally parallel tracks. Each of the tracks has an outer wall, front and back intermediate walls and front and back inner walls collectively defining a channel. A sash window is transversely disposed between the tracks and is adapted for slidable movement along the tracks. A pair of sash balance assemblies provides a generally upward bias on transverse sides of the sash window. The sash balance brake assembly is placed in a respective one of each of the channels.

In accordance with the invention, the improved sash balance brake assembly comprises a rotor having a rotor camming surface and being rotatable about a rotor axis. A slider body is placed in a respective one of the channels for coupling to a respective one of the sash balance assemblies. The slider body includes means for rotatably supporting the rotor such that the camming surface is directed outwardly towards the respective outer wall. A bolt is provided having a bolt camming surface in operative engagement with the rotor camming surface, such that rotation of the rotor moves the bolt along the rotor axis and into engagement with the outer wall.

It is comprehended that the rotor is formed of glass filled nylon or metal, such as zinc.

It is further comprehended that the slider body includes means for retaining the rotor, such as a spring clip.

It is still further comprehended that the rotor camming surface and the bolt camming surface each include a pair of raised surfaces disposed between a pair of recessed surfaces.

Other features and advantages of the invention will be apparent from the following specification taken in conjunction with the following drawing.

DETAILED DESCRIPTION

Figure 1:
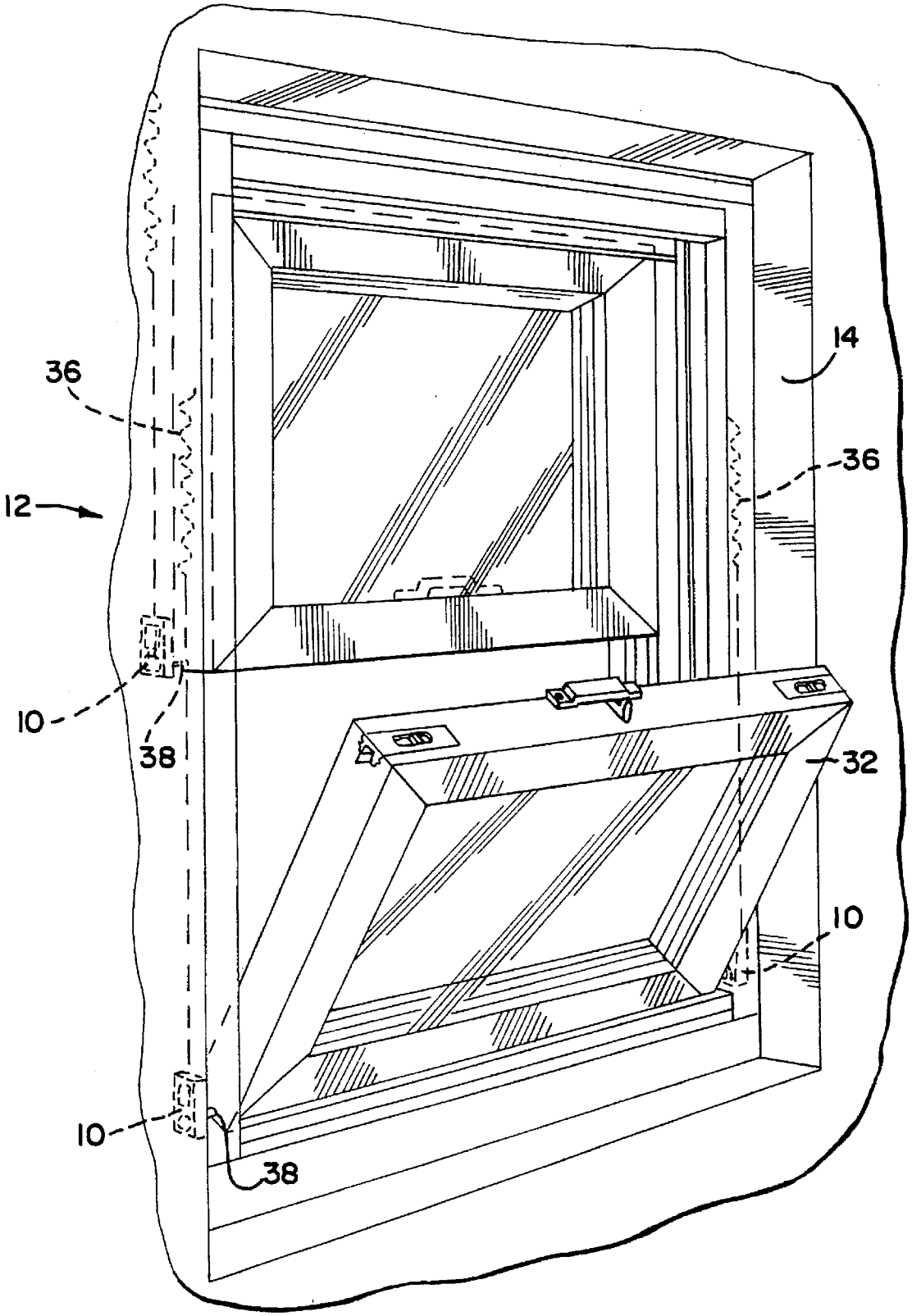
FIG. 1 is a perspective view of a sash window system.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

A sash balance brake assembly, generally designated 10, for a sash window system 12 is illustrated in FIG. 1. The sash window system 12 includes a window frame 14.

Figure 3:
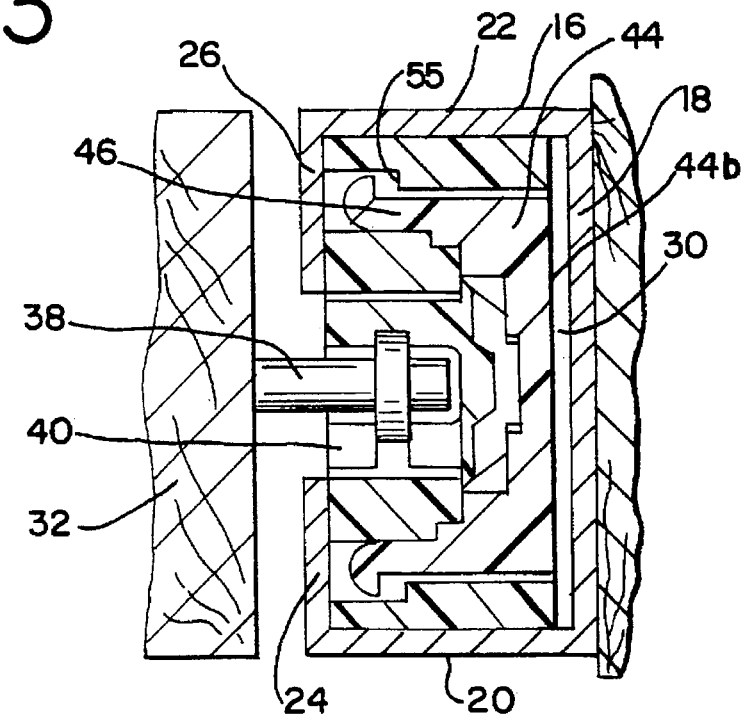
FIG. 3 is a sectional view of the sash balance brake assembly of FIG. 2, shown in the released position.

Referring to FIG. 3, the sash window system 12 has a pair of generally parallel tracks 16. Each of the tracks 16 has an outer wall 18, front and back intermediate walls 20, 22, respectively, and front and back inner walls 24, 26, respectively. The walls 18, 20, 22, 24, 26 collectively define a channel 30.

Referring again to FIG. 1, a sash window 32 is transversely disposed between the tracks 16 for slidable movement along the tracks 16, as is well known. A pair of sash balance assemblies 36 for providing a generally upward bias on transverse sides of the sash window 32. A pair of sash balance pivot pins 38 extend from the base of each of the sash windows 32.

Figure 2:
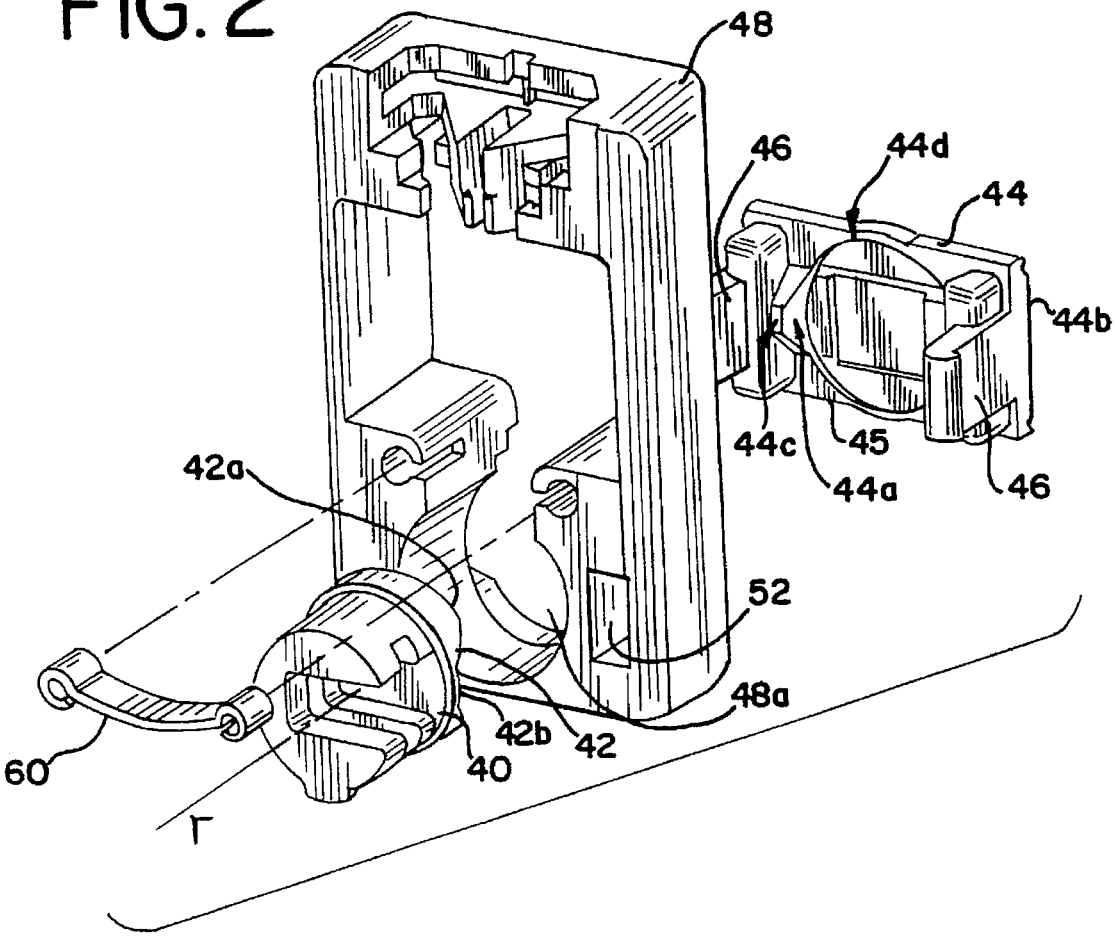
FIG. 2 is a perspective view of a sash balance brake assembly in accordance with the invention.
Figure 4:
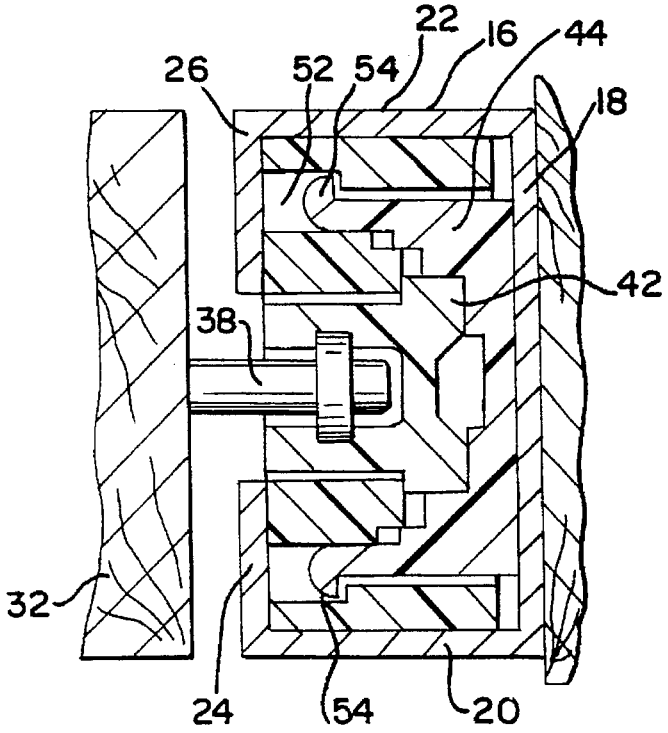
FIG. 4 is a sectional view of the sash balance brake assembly of FIG. 2, shown in the engaged position.

Referring to FIGS. 2, 3 and 4, the sash balance brake assembly 10 for placement in a respective one of each of the channels 30 comprises a generally cylindrical rotor 40 having a rotor axis "r" and a rotor camming surface 42 generally perpendicular to the rotor axis "r". The rotor camming surface 42 includes a pair of raised segments 42*a* disposed between a pair of recessed segments 42*b*.

A bolt 44 having a body having a first side 45 defining a bolt camming surface 44*a* and a second, opposite side 44*b* defining an engaging surface. The bolt camming surface 44*a* includes a pair of raised segments 44*c* disposed between a pair of recessed segments 44*d*. The bolt 44 further includes two generally parallel bolt legs 46 extending perpendicularly away from the first side 45. A slider body 48 is provided for placement in a respective one of the channels 30 and for coupling to a respective one of the sash balance assemblies 10. The slider body 48 has a generally circular aperture 48*a* for receiving and rotatably supporting the rotor 40 along the rotor axis "r" such that the rotor camming surface 42 is directed outwardly towards the respective outer wall 18. The slider body 48 further includes a pair of slots 52, one for receiving a respective one of the bolt legs 46. Each of the bolt legs includes a tab 54, and each of the slider body slots 52 includes a recessed step 55 for retaining a respective one of the tabs 54. The bolt camming surface is disposed in operative engagement with the rotor camming surface 42, such that rotation of the rotor along the rotor axis moves the bolt 44 along the rotor axis.

The rotor 40 is formed of glass filled nylon. Alternatively, the rotor 40 could be formed of glass filled isoplast or metal, such as zinc, for additional strength.

Figure 2A:
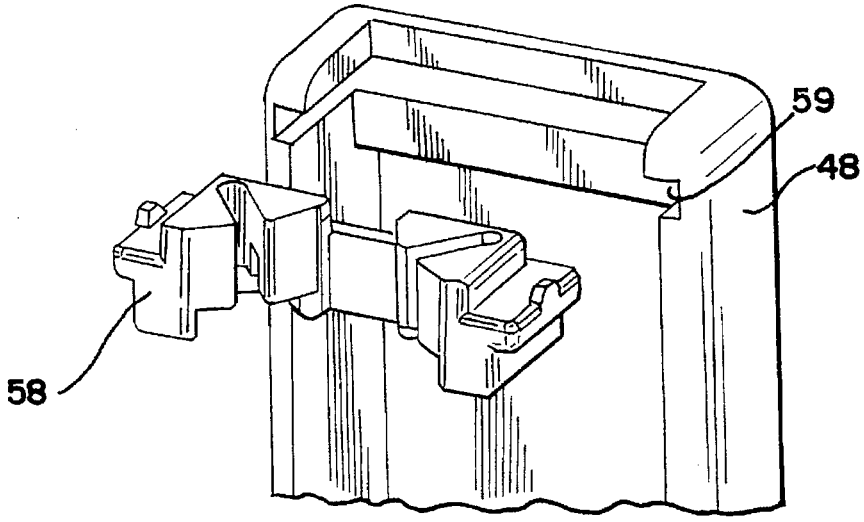
FIG. 2*a* is a partial perspective view of an alternative construction of the sash balance brake assembly of FIG. 2.

The slider body 48 is a unitary assembly formed of glass filled nylon. Alternatively, the slider body 48 could be formed of glass filled isoplast for additional strength, if necessary. As illustrated in FIG. 2*a*, a strengthening insert 58, such as of zinc, can be provided in a slot 59 to strengthen the slider body 48, where the slider body 48 is attached to the sash balance assembly.

The slider body 48 generally surrounds the rotor 40 to thereby retain the rotor 40 in the aperture 48*a*. Alternatively, the sash balance brake assembly 10 can include a spring clip 60 to provide a further means for retaining the rotor 40 in the slider body 48.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. For a sash window system including a window frame having a pair of generally parallel tracks, each of said tracks having an outer wall, front and back intermediate walls and front and back inner walls collectively defining a channel, a sash window transversely disposed between said tracks and adapted for slidable movement along said tracks, and a pair of sash balance assemblies for providing a generally upward bias on transverse sides of said sash window, an improved sash balance brake assembly for each of said sash balance assemblies and for placement in a respective one of each of said channels, said improved sash balance brake assembly comprising:

a rotor rotatable about a rotor axis;

a bolt having a generally planar engaging surface and two generally parallel bolt legs; and a slider body for placement in a respective one of said channels and for coupling to a respective one of said sash balance assemblies, said slider body having a generally circular aperture for receiving and rotatably supporting said rotor along said rotor axis, the slider body further having a pair of slots spaced from said aperture, one of said slots receiving and housing a respective one of said bolt legs within said slider body, said rotor being adjacent said bolt, said rotor and said bolt including cooperative means for converting rotary motion of said rotor into movement of said bolt along said rotor axis, such that said bolt engaging surface selectively engages and disengages said track outer wall.

2. The improved sash balance brake assembly of claim 1 wherein said slider body is a unitary assembly.

3. The improved sash balance brake assembly of claim 1 where said slider body is formed of glass filled nylon.

4. The improved sash balance brake assembly of claim 1 where said slider body is formed of glass filled isoplast.

5. For a sash window system including a window frame having a pair of generally parallel tracks, each of said tracks having an outer wall, front and back intermediate walls and front and back inner walls collectively defining a channel, a sash window transversely disposed between said tracks and adapted for slidable movement along said tracks, and a pair of sash balance assemblies for providing generally upward bias on transverse sides of said sash window, an improved sash balance brake assembly for each of said sash balance assemblies and for placement in a respective one of each of said channels, said improved sash balance brake assembly comprising:

a rotor having a rotor camming surface and being rotatable about a rotor axis;

a slider body for placement in a respective one of said channels and for coupling to a respective one of said sash balance assemblies and having a generally circular aperture for receiving and rotatably supporting said rotor along said rotor axis such that said rotor camming surface is directed outwardly towards said respective outer wall, said slider body further having a pair of slots spaced from said aperture, each slot having a recessed step; and a bolt having two generally parallel bolt legs, each leg being received by a respective slot of the slider body, each leg having a tab that is retained by the recessed step of the respective slot of the slider body, said bolt further having a bolt camming surface in operative engagement with said rotor camming surface, such that rotation of said rotor moves said bolt along said rotor axis and into engagement with said outer wall.

6. The improved sash balance brake assembly of claim 5 wherein said rotor is formed of glass filled nylon.

7. The improved sash balance brake assembly of claim 5 wherein said rotor is formed of metal.

8. The improved sash balance brake assembly of claim 7 wherein said metal is zinc.

9. The improved sash balance brake assembly of claim 5 including means for retaining said rotor in said slider body.

10. The improved sash balance brake assembly of claim 9 wherein said retaining means comprises a spring clip.

11. The improved sash balance brake assembly of claim 5 wherein said rotor camming surface and said bolt camming surface each include a pair of raised surfaces disposed between a pair of recessed surfaces.

12. The improved sash balance brake assembly of claim 5 wherein said slider body is a unitary assembly.

13. The improved sash balance brake assembly of claim 5 wherein said slider body includes a strengthening insert.

14. The improved sash balance brake assembly of claim 13 wherein said insert is formed of metal.

15. The improved sash balance brake assembly of claim 14 wherein said metal is zinc.

16. A sash balance brake assembly for a sash window system, said sash window system including a window frame having a pair of generally parallel tracks, each of said tracks having an outer wall, front and back intermediate walls and front and back inner walls, said walls collectively defining a channel, a sash window transversely disposed between said tracks for slidable movement along said tracks, and a pair of sash balance assemblies for providing a generally upward bias on transverse sides of said sash window, said sash balance brake assembly for placement in a respective one of each of said channels, said improved sash balance brake assembly comprising:

a generally cylindrical rotor having a rotor axis and a rotor camming surface generally perpendicular to said rotor axis;

a bolt having a body having a first side defining a bolt camming surface and a second, opposite side defining an engaging surface, and two generally parallel bolt legs extending perpendicular away from said first side; and a slider body for placement in a respective one of said channels and for coupling to a respective one of said sash balance assemblies, said slider body having a generally circular aperture for receiving and rotatably supporting said rotor along said rotor axis such that said rotor camming surface is directed outwardly towards said respective outer wall, said slider body further having a pair of slots spaced from said aperture, one for receiving a respective one of said bolt legs, wherein each of said bolt legs includes a tab, and each of said slots includes a recessed step for retaining a respective one of said tabs, wherein said bolt camming surface is disposed in operative engagement with said rotor camming surface, such that rotation of said rotor along said rotor axis moves said bolt along said rotor axis.

17. The sash balance brake assembly of claim 16 wherein said rotor is formed of glass filled nylon.

18. The sash balance brake assembly of claim 16 wherein said rotor is formed of metal.

19. The sash balance brake assembly of claim 18 wherein said metal is zinc.

20. The sash balance brake assembly of claim 16 including means for retaining said rotor in said slider body.

21. The sash balance brake assembly of claim 20 wherein said retaining means comprises a spring clip.

22. The sash balance brake assembly of claim 16 wherein said rotor camming surface and said bolt camming surface each include a pair of raised surfaces disposed between a pair of recessed surfaces.

* * * * *

UNITED STATES PATENT AND TRADEMARK OFFICE

CERTIFICATE OF CORRECTION

PATENT NO. : 5,632,117

DATED : May 27, 1997

INVENTOR(S) : James G. Prete, Steven E. Schultz and Allen D. Polowinczak

It is certified that error appears in the above-indentified patent and that said Letters Patent is hereby corrected as shown below:

On the title page, insert the following:

-- [73] Assignee: Ashland Products, Inc., Lowell, Ind. --.

Signed and Sealed this

Twenty-sixth Day of October, 1999

*Attest:*

Q. TODD DICKINSON

*Attesting Officer*

*Acting Commissioner of Patents and Trademarks*